US009124995B2

(12) United States Patent
Burk et al.

(10) Patent No.: US 9,124,995 B2
(45) Date of Patent: Sep. 1, 2015

(54) REVISION CONTROL WITHIN HEARING-AID FITTING SOFTWARE

(75) Inventors: Matthew Burk, Plymouth, MN (US); Daniel Mark Edgar, Lakeville, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 513 days.

(21) Appl. No.: 13/340,281

(22) Filed: Dec. 29, 2011

(65) Prior Publication Data

US 2012/0219159 A1 Aug. 30, 2012

Related U.S. Application Data

(60) Provisional application No. 61/428,611, filed on Dec. 30, 2010.

(51) Int. Cl.
*H04R 25/00* (2006.01)

(52) U.S. Cl.
CPC ..... *H04R 25/70* (2013.01); *H04R 25/00* (2013.01); *H04R 25/30* (2013.01)

(58) Field of Classification Search
CPC ..... H04R 25/00; H04R 25/30; H04R 25/70
USPC ..... 381/60, 312–331; 600/559
See application file for complete search history.

(56) References Cited

U.S. PATENT DOCUMENTS

2006/0098831 A1* 5/2006 Kaiser et al. ..... 381/312
2010/0271373 A1* 10/2010 Edgar ..... 345/440

FOREIGN PATENT DOCUMENTS

EP 2472909 A2 7/2012

OTHER PUBLICATIONS

Phonak Target feature guide, http://www.phonakpro.com/content/dam/phonak/b2b/C_M_tools/Library/background_stories/en/Phonak_Insight_Phonak_Target_210×280_GB_V1.00.pdf, Jul. 2010.*

"European Application Serial No. 11196270.0, Response filed Apr. 4, 2012 to Office Action mailed Feb. 23, 2012", 4 pgs.

* cited by examiner

*Primary Examiner* — Matthew Eason
(74) *Attorney, Agent, or Firm* — Schwegman Lundberg & Woessner, P.A.

(57) ABSTRACT

A method for revision control within hearing-aid fitting software may include storing session fitting data for a plurality of fitting sessions of a hearing assistance device; displaying a graphical user interface, the graphical user interface including a list of the plurality of fitting sessions of the hearing assistance device, the graphical user interface allowing for selection of two or more fitting sessions for display; receiving a selection of a fitting session from the list; and in response to receiving the selection, updating the graphical user interface to include a response curve related to the selected fitting session.

16 Claims, 5 Drawing Sheets

REVISION CONTROL WITHIN HEARING-AID FITTING SOFTWARE

RELATED APPLICATION

This patent application claims the benefit of priority, under 35 U.S.C. §119(e), to U.S. Provisional Patent Application Ser. No. 61/428,611, entitled "REVISION CONTROL WITHIN HEARING-AID FITTING SOFTWARE," filed on Dec. 30, 2010, which is hereby incorporated by reference herein in its entirety.

FIELD OF THE INVENTION

The present subject matter relates generally to tracking hearing aid response.

BACKGROUND

Modern hearing aid fitting software provides a clinician with a display of response curve associated with the gain of a hearing assistance device. A clinician uses the fitting software to adjust the gain and other settings of the hearing assistance device so that the hearing assistance device's output in the wearer's ear matches a prescribed target. However, the fitting software lacks the ability to quickly compare changes in the gain response curve across multiple fitting sessions. Accordingly, there is a need in the art for apparatus and methods to provide improved visualization of changes in gain response curves over time.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Hearing assistance devices are electronic devices that provide better listening for wearers. One type of hearing assistance device is a hearing aid. Hearing aids provide signal processing functions such as noise reduction, acoustic feedback cancellation, and frequency-dependent amplification to correct for an individual's hearing loss. Various prescriptive fitting formulae can be used to calculate custom targets for the hearing aid response. A goal of the fitting is to adjust the gain of the hearing aid so that its output in the patient's ear matches the prescribed targets. Fitting software is often used to help achieve this goal. In some cases, the fitting software automatically adjusts gain, but allows adjustments to be made by a clinician.

Revision tracking is used to track changes in a file across a period of time. For example, a user can crop portions out of a digital photo. If the user then saves the photo, the information that was cropped out of the picture is lost. However, if revision tracking is used, the user can compare the cropped version of the photo and the original version of the photo.

Currently, a problem exists in the area of hearing assistance devices fitting software in that there is no way to visually compare changes made from one fitting session to another. In various embodiments, revision tracking is used to store fitting session data to allow a user to visually compare data from one fitting session with another fitting session. Revision tracking aids the audiologist/dispenser in being able to better visualize changes made from session to session and in counseling subjects regarding the changes they made and why. If a patient complains of a change made, it becomes easy to see what the change was relative to previous settings. Although the changes tracked in the following examples focus on the gain curves, the same abilities could be used for compression settings or other tabular number that may change over time.

Figure 1:
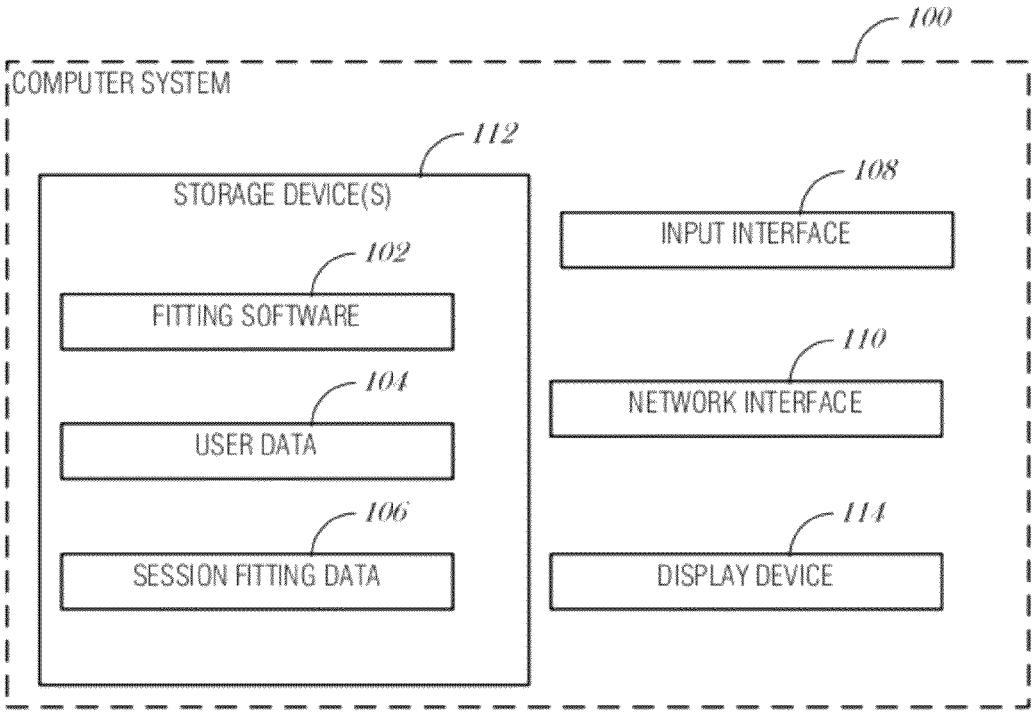
FIG. 1 shows an example computer system, according to one embodiment of the present subject matter.

FIG. 1 illustrates an example computer system that is used to implement revision tracking of fitting session data according to one embodiment of the present subject matter. Illustrated is computer system 100 including fitting software 102, user data 104, session fitting data 106, input interface 108, network interface 110, storage device 112, and display interface 114. In various embodiments, fitting software 102 is software that is used by a user (e.g., a clinician) to make adjustments to the gain of a hearing assistance device. In various applications, other parameters of the hearing assistance device can be adjusted and selected. In various embodiments, fitting software 102 retrieves user data 104 and session data 106 from storage device 112 and displays a user interface on display device 114.

In various embodiments, user data 104 includes data for one or more wearers of hearing assistance devices. The user data includes identifying information such as name or other identifying information. User data 104 is associated with one or more instances of session fitting data 106. An instance of session fitting data includes, but is not limited to, one or more of: frequency dependent gain information, acoustic feedback canceller information, noise management information, selectable parameters, mode selection information, and/or other settings for a hearing assistance device. Collectively, session fitting data may be considered a hearing assistance device profile.

Input interface 108 facilitates input from users of the fitting software. Inputs include, but are not limited to, pointer device, touch, voice, gesture, and keyboard inputs. A user of fitting software 102 uses one or more of the input methods to interact with the fitting software and adjust one or more parameters of the hearing assistance device. For example, a user may make adjustments to a gain response curve by using a mouse. In an example embodiment, the input interface is in a different location than the display interface. For example, a clinician may control the fitting software in a location remote from the location of the fitting software. The present subject matter is also useful for systems which automatically calculate settings.

Storage device 112 stores fitting software 102, user data 104, and session fitting data 106. In an example embodiment, storage device 112 is distributed across one or more machine-readable media. In various embodiments, different types of storage may be employed. Storage includes, but is not limited to, one or more of hard drives, RAM, ROM, EEPROM, and combinations of them. In various embodiments, storage device 112 includes storage at different locations. For example, user data 104 may be stored on one hard drive while the fitting software is stored on a second hard drive. In an example embodiment, storage device 112 is in a location remote from where the fitting software is being executed. In various embodiments fitting software 102 (e.g., instructions) is executed on one or more processors as a series of instructions.

Figure 2:
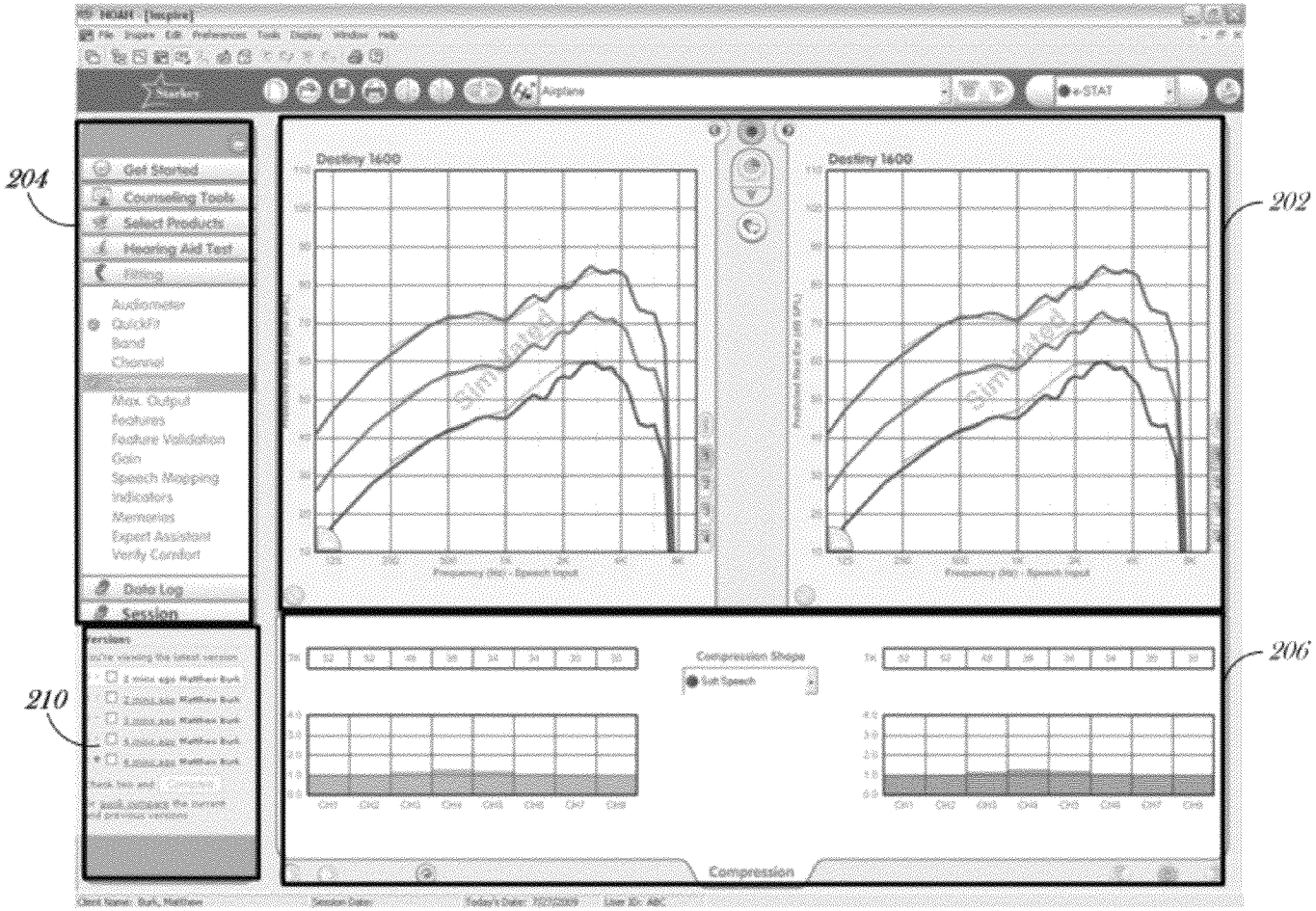
FIG. 2 shows a hearing aid fitting software interface according to one embodiment of the present subject matter.

FIG. 2 shows one example of a hearing aid fitting software interface. The interface include a first portion 202 displaying gain graphs associated with a wearer's hearing aids. Two graphs are displayed, one for the wearer's left ear and one for the right ear. The software interface also includes a second portion that displays a list of previous fitting sessions for a hearing assistance device of wearer 210. A third portion 204 of the software interface includes a menu of options available to a clinician associated with the hearing assistance device. A fourth portion 206 of the software interface includes data associated with the selected menu options. As compression is selected in FIG. 2, the fourth portion 206 displays data related to compression. The interface has been separated into four portions for illustration purposes and various interfaces may have more or less portions.

In various embodiments of the present subject matter, the list of fitting sessions includes, but is not limited to, user input indicia, time data, and user identifying data. The user input indicia in FIG. 2 are depicted as checkboxes. Other input indicia include, but are not limited to, radio boxes, drop-down lists, or button. The time data indicates the temporal relationship between the current fitting session and another fitting session completed at a different than the current fitting session. In an example embodiment, the actual time of the other fitting session may be displayed in place of, or in addition to, the relative time. In various embodiments the list of fitting sessions is hidden. By clicking on the "Session" button in the left column, a listing of all fitting sessions appears allowing the user to select a single or multiple fitting sessions for comparison. Note that no other fitting sessions are selected in FIG. 2. Thus, the software interface displays response curves for the current fitting session.

Figure 3:
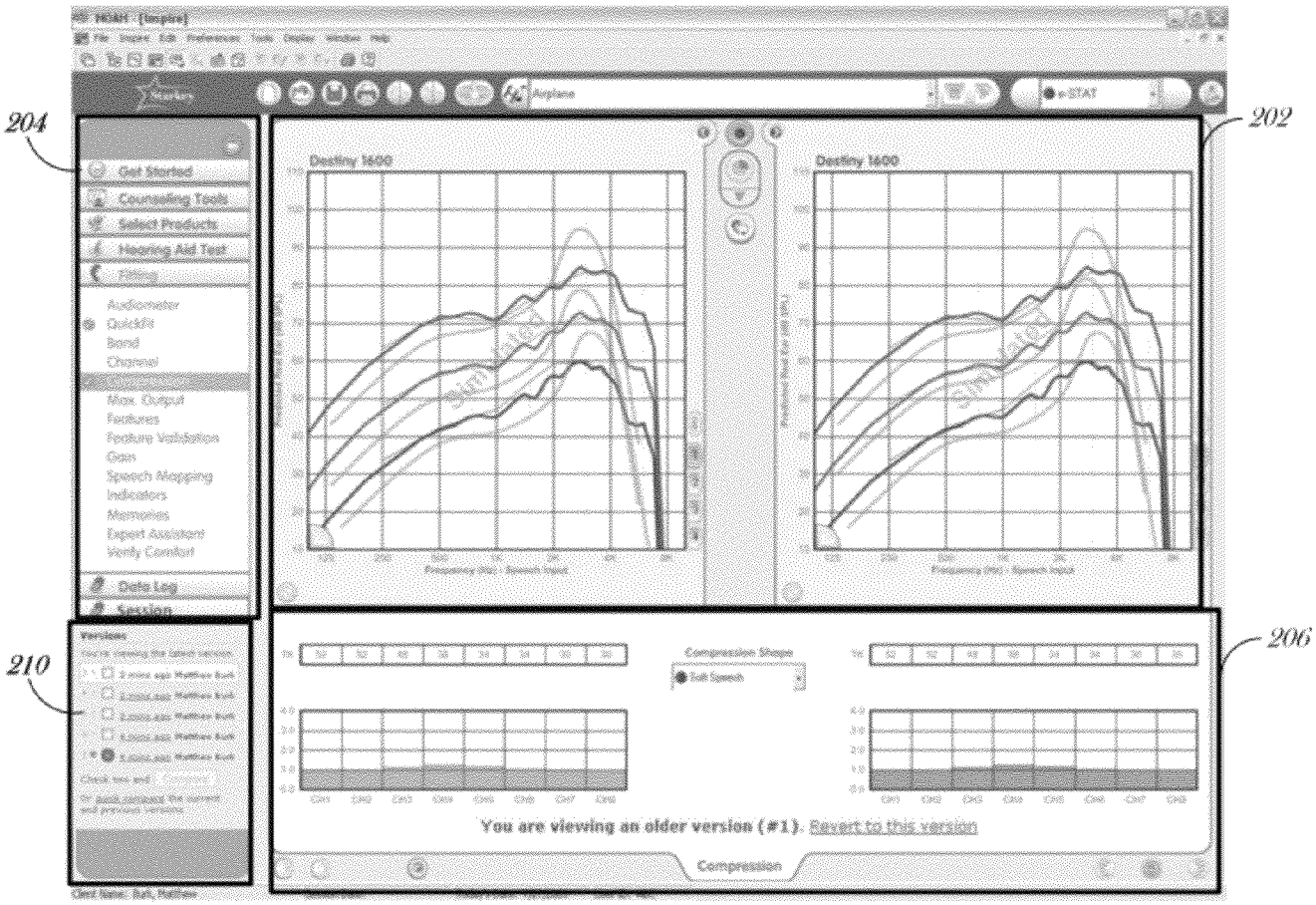
FIG. 3 shows the hearing aid fitting software interface of FIG. 2 with additional information from another version of the fitting, according to one embodiment of the present subject matter.

FIG. 3 illustrates example hearing aid fitting software. The interface includes the same four portions as illustrated in FIG. 2. However, in FIG. 3 the user input indicia for another fitting session has been activated (e.g., selected). The fitting software interface displays a notice indicating the user is currently viewing an older version of fitting session data. In an example embodiment, the response curves for the selected fitting session are illustrated simultaneously with the response curves for the current fitting session.

To visually compare the two sets of response curves, the software interface displays the graphs in different formats. For example, each set of response curves may be differentiated by color, width, pattern, and transparency, or combinations thereof. In an embodiment, a legend is presented that informs the user which response curve belongs to which fitting session. In an embodiment, a user hovers over a fitting session in the legend or list of fitting sessions to hide response curves associated with other fitting sessions.

In various embodiments, the user can revert settings in the hearing assistance device to any selected session. If the user selects (e.g., uses a pointer device to click on "Revert to this version") the hearing assistance device profile for a particular fitting session, then data is loaded into the hearing assistance device from that fitting session. In the case of gain response curves, clicking "Revert to this version" changes the gain settings to match the selected session. This feature can facilitate comparison of settings of the hearing assistance device by the wearer by changing settings between various fitting versions.

Figure 4:
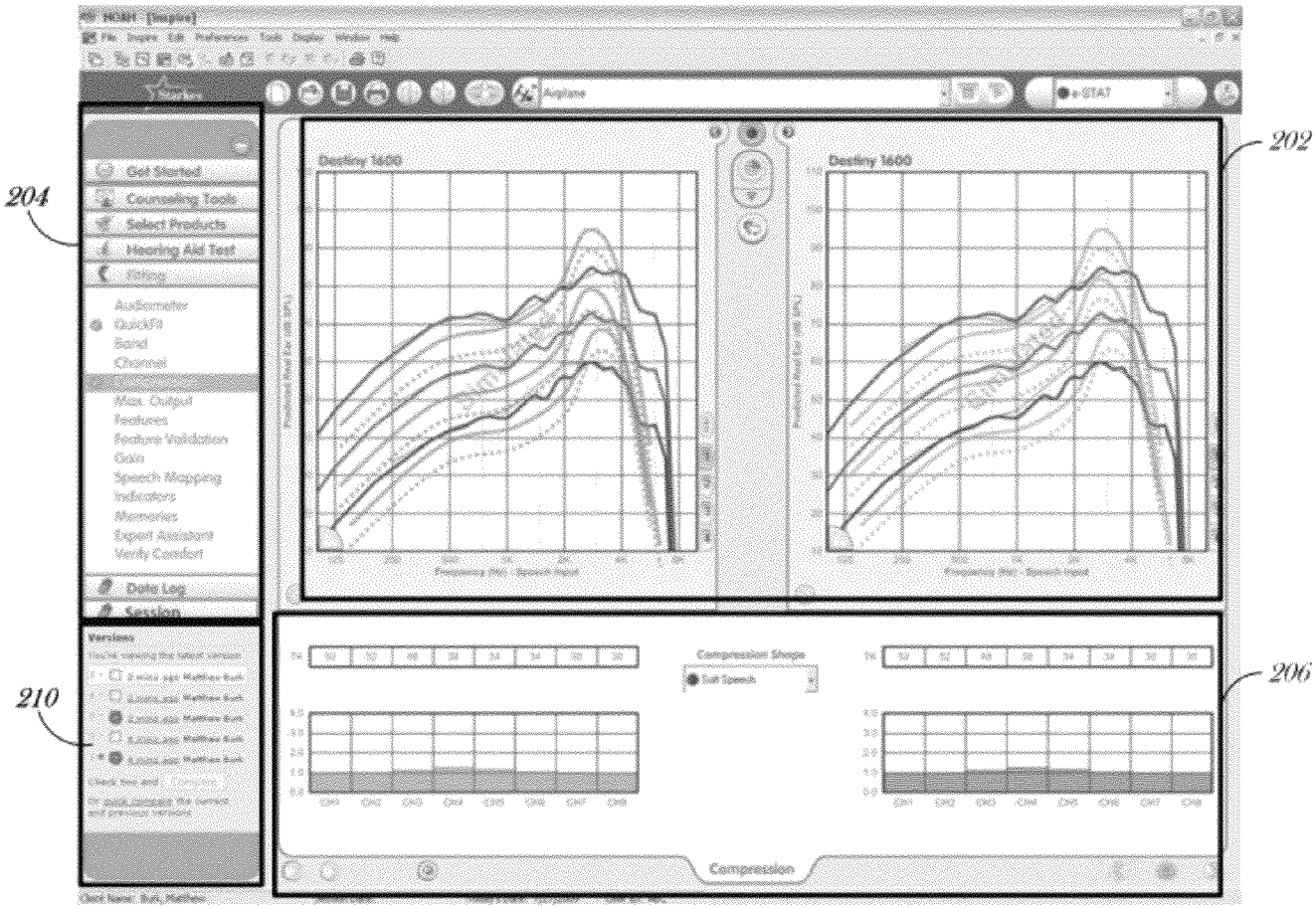
FIG. 4 shows the hearing aid fitting software interface of FIG. 2 with additional information from another version of the fitting, according to one embodiment of the present subject matter.

FIG. 4 illustrates an example of the hearing aid fitting software with two additional listings of session data selected. The second portion of the interface includes three sets of response curves. Each set of response curves is visually differentiated to allow a user to quickly compare the three sets of response curves.

Figure 5:
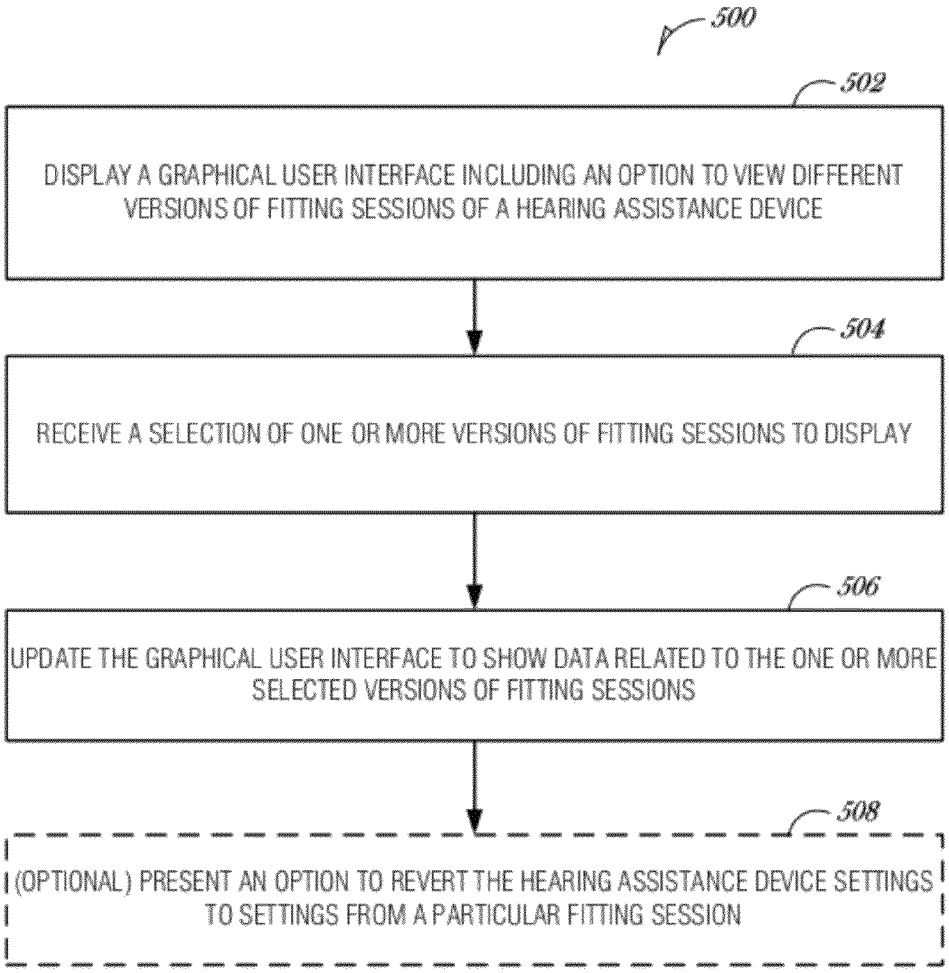
FIG. 5 illustrate a process according to one embodiment of the present subject matter.

FIG. 5 illustrates a flowchart of a method 500 according to one embodiment of the present subject matter. In one embodiment, a graphical user interface is displayed 502. In various embodiments, the graphical user interface includes a first portion including a response curve related to a first fitting session for a hearing assistance device, and a second portion including a list of fitting sessions for the hearing assistance device. In various embodiments, data representing the first fitting session is displayed in the list of the second portion of the graphical user interface. For example, the data representing one fitting session includes user input indicia, time data, and user identifying data. In various embodiments, the graphical user interface further includes data representing one or more other fitting sessions in the list of the second portion of the graphical user interface. In an example embodiment, the response curves are related to gain for a hearing assistance device.

A selection of a fitting session version (or versions) is received from the list displayed in the second portion of the graphical user interface 504. For example, this may include receiving a selection of a first fitting session and receiving a selection of a first fitting session and a second fitting session. A current session can be selected with one or more other sessions. In an embodiment, the current session is selected by default. Thus, several versions may be programmably selected by the user. The terms "first" and "second" are used for identification purposes and are not intended to convey an order. Thus, the first fitting session may have be completed after the second fitting session.

A first portion of the graphical user interface is updated to include response curves related to the selection of fitting sessions 506. For example, the response curve related to the first fitting session is displayed in a first format and a response curve related to another fitting session is displayed in another format.

An optional step allows for a presentation of an option to revert the hearing assistance device profile to a selected fitting session 508. In various embodiments, the hearing assistance device profile is updated with data related to the selected fitting session.

It is understood that this method demonstrates the present subject matter and is not intended to be limiting or exhaustive. For example, the method discusses the presentation of curves, however, it is understood that other data may be used without departing from the scope of the present subject matter. For example, tabular data may be used. As another example, the approach can be used with a variety of other data, such as compression data, data relating to maximum stable gain data relating to gain margin, acoustic feedback cancellation data, and other data. Thus, the present subject matter can be used with a variety of different versions of fitting parameters and depictions of same without departing from the present subject matter.

The present subject matter can be used for a variety of hearing assistance devices, including but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, such as receiver-in-the-canal (RIC) or receiver-in-the-ear (RITE) designs. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method comprising:

storing session fitting data for a plurality of fitting sessions of a hearing assistance device;

displaying a graphical user interface, the graphical user interface including a list of the plurality of fitting sessions of the hearing assistance device, the list of the graphical user interface allowing for selection of two or more fitting sessions for display;

receiving a selection of at least two fitting sessions from the list, the selection including a first fitting session and a second fitting session; and in response to receiving the selection, updating a portion of the graphical user interface to overlay a response curve related to the first fitting session with a response curve related to the second fitting session, wherein the response curve related to the first fitting session is in a first format and the response curved related to the second fitting session is in a second format.

2. The method of claim 1, wherein displaying a graphical user interface includes displaying data representing a current fitting session of the hearing assistance device in the list.

3. The method of claim 2, wherein displaying a graphical user interface includes displaying data representing fitting sessions completed at a time different than the current fitting session in the list.

4. The method of claim 1, further comprising:

displaying in the graphical user interface an option to apply a hearing assistance device profile of a selected fitting session to the hearing assistance device; and based on receiving a user preference indicating acceptance of the option, updating the hearing assistance device profile with data related to the selected fitting session.

5. The method of claim 1, wherein displaying a response curve related to the first fitting session for a hearing assistance device includes displaying a response curve related to gain curves.

6. The method of claim 1, further comprising presenting an option in the graphical user interface to revert settings of the hearing assistance device to data associated with a selected fitting session.

7. A machine-readable storage device comprising instructions, which when executed by at least one processor, cause the at least one processor to:

store session fitting data for a plurality of fitting sessions of a hearing assistance device;

display a graphical user interface, the graphical user interface including a list of the plurality of fitting sessions of the hearing assistance device, the list of the graphical user interface allowing for selection of two or more fitting sessions for display;

receive a selection of at least two fitting sessions from the list including a first fitting session and a second fitting session; and in response to receiving the selection, update a portion of the graphical user interface to overlay a response curve related to the first fitting session with a response curve related to the second fitting session, wherein the response curve related to the first fitting session is in a first format and the response curved related to the second fitting session is in a second format.

8. The storage device of claim 7, wherein the graphical user interface includes data representing a current fitting session of the hearing assistance device in the list.

9. The storage device claim 7, further comprising instructions to:

display in the graphical user interface an option to apply a hearing assistance device profile of a selected fitting session to the hearing assistance device; and based on receiving a user preference indicating acceptance of the option, update the hearing assistance device profile with data related to the selected fitting session.

10. A system comprising:

a storage device configured to store session fitting data for a plurality of fitting sessions of a hearing assistance device; and a display device configured to display a graphical user interface including a list of the plurality of fitting sessions of the hearing assistance device, the list of the graphical user interface configured to allow for selection of two or more fitting sessions for display; and an input interface configured to receive a selection of at least two fitting sessions from the list including a first fitting session and a second fitting sessions, and wherein a portion of the graphical user interface is, in response to the selection, updated to overlay a response curve related to the first fitting session with a response curve related to the second fitting session, wherein the response curve related to the first fitting session is in a first format and the response curved related to the second fitting session is in a second format.

11. The system of claim 10, wherein the graphical user interface includes an option to apply a hearing assistance device profile of a selected fitting session to the hearing assistance device; and based on receiving a user preference indicating acceptance of the option, updating the hearing assistance device profile with data related to the selected fitting session.

12. The system of claim 10, wherein the response curve related to the first fitting session is a gain curve.

13. The system of claim 10, wherein the session fitting data includes gain settings for the hearing assistance device.

14. The system of claim 10, wherein the session fitting data includes noise management parameters.

15. The system of claim 10, wherein the list includes a time associated with a fitting session.

16. The system of claim 10, wherein the hearing assistance device is a behind-the-ear hearing assistance device.

* * * * *